US007111595B2

(12) United States Patent
Sedda et al.

(10) Patent No.: US 7,111,595 B2
(45) Date of Patent: Sep. 26, 2006

(54) ELECTROMECHANICAL VALVE CONTROL ACTUATOR FOR INTERNAL COMBUSTION ENGINES

(75) Inventors: Emmanuel Sedda, Conflans Sainte (FR); Christophe Fageon, Montrouge (FR); Hamid Ben Ahmed, Rennes (FR); Michel Lecrivain, Ivry Sur Seine (FR); Mohamed Gasbi, Cachan (FR)

(73) Assignees: Peugeot Citroen Automobiles SA, Velizy-Villacoublay Cedex (FR); CNRS, Paris (FR)

( * ) Notice: Subject to any disclaimer, the term of this patent is extended or adjusted under 35 U.S.C. 154(b) by 0 days.

(21) Appl. No.: 10/779,973

(22) Filed: Feb. 17, 2004

(65) Prior Publication Data

US 2005/0034690 A1 Feb. 17, 2005

(30) Foreign Application Priority Data

Feb. 18, 2003 (FR) ..... 03 01948

(51) Int. Cl.
*F01L 9/04* (2006.01)

(52) U.S. Cl. ..... 123/90.11; 251/129.01; 251/129.15; 251/129.16

(58) Field of Classification Search ..... 123/90.11; 251/129.1, 129.16, 129.15, 129.01
See application file for complete search history.

(56) References Cited

U.S. PATENT DOCUMENTS

| | | | | |
|---|---|---|---|---|
| 3,858,135 | A | 12/1974 | Gray | |
| 4,533,890 | A | 8/1985 | Patel | |
| 4,715,332 | A | 12/1987 | Kreuter | |
| 5,992,821 | A * | 11/1999 | Rookes et al. | 251/129.1 |
| 6,198,370 | B1 | 3/2001 | Schmitz | |
| 6,216,653 | B1 | 4/2001 | Okada et al. | |
| 6,308,667 | B1 | 10/2001 | Tsai et al. | |

FOREIGN PATENT DOCUMENTS

| | | | |
|---|---|---|---|
| DE | 35 00 530 | A | 7/1986 |
| DE | 100 03 928 | A | 6/2001 |
| EP | 0 422 228 | A | 4/1991 |
| EP | 0 504 806 | A | 8/1992 |
| EP | 0 816 644 | A | 1/1998 |
| EP | 1 010 866 | A | 6/2000 |
| EP | 1 174 595 | A | 1/2002 |
| EP | 1 174 596 | A | 1/2002 |
| EP | 1 264 969 | A | 12/2002 |
| FR | 2 784 497 | A | 4/2000 |
| FR | 2 822 585 | A | 9/2002 |
| JP | 2001-035721 | A | 2/2001 |
| JP | 2002 130510 | A | 5/2002 |

OTHER PUBLICATIONS

French Search Report dated Nov. 5, 2003 (3 pages).

* cited by examiner

*Primary Examiner*—Thomas Denion
*Assistant Examiner*—Zelalem Eshete
(74) *Attorney, Agent, or Firm*—RatnerPrestia

(57) ABSTRACT

A valve actuator for internal combustion engines, includes at least one electromagnet and a magnetic plate, whose movement controls the displacement of the valve. The parameters of the electromagnet and of the plate are such that at least part of the magnetic circuit formed by the electromagnet and the magnetic plate is in a state of magnetic saturation when the magnetic plate is located in the proximity of the electromagnet. The magnetic circuit is preferably in the state of magnetic nonsaturation when it is located at a distance from the electromagnet. According to one embodiment, the magnetic plate has at least one contracted part intended to be saturated when this plate is located in the proximity of the electromagnet.

16 Claims, 2 Drawing Sheets

ELECTROMECHANICAL VALVE CONTROL ACTUATOR FOR INTERNAL COMBUSTION ENGINES

FIELD OF THE INVENTION

The present invention pertains to an electromechanical valve control actuator for internal combustion engines.

BACKGROUND

FIG. 1 shows an example of an electromechanical actuator 100 of a valve 110 which comprises mechanical means, such as springs 102 and 104, and electromagnetic means with two electromagnets 106 and 108 for controlling the position of the valve 110 by means of electric signals.

In the example, the rod 113 of the valve 110 is applied for this purpose against the rod 112 of a magnetic plate 114 located between the two electromagnets 106 and 108.

When a current flows in the coil 109 of the electromagnet 108, the latter is activated and generates a magnetic field attracting the plate 114, which comes into contact with it.

This results in a displacement of the rod 112, which moves away from the rod 113, enabling the spring 102 to act to bring the valve 110 into the closed position, the head of the valve 110 coming against its seat 111 and preventing the exchange of gas between the interior and the exterior of the cylinder 116.

Analogously, when the electromagnet 108 is deactivated, when a current flows in the coil 107 of the electromagnet 106, the latter attracts the plate 114, which comes into contact with it and pushes the rod 112 by means of the spring 104 against the rod 113 such that the rod 112 acts on the valve 110 and brings the latter into the open position, the head of the valve being moved away from its seat 111 to permit, for example, the admission or the injection of gas into the cylinder 116.

Thus, the valve 110 alternates between the open or closed positions, called switched positions, with transient displacements between these two positions. The state of an open or closed valve will hereinafter be called the "switched state."

The actuator 100 requires the use of a magnetic plate 114 of a heavy mass due especially to its considerable thickness Sp. This thickness is generally equal to the width $S_e$ of the branches of the electromagnets to achieve optimal functioning of the actuator. In fact, the branches of the electromagnet and the plate thus form a magnetic circuit of constant cross section.

However, the use of a plate 114 of a considerable cross section and consequently of a heavy mass has drawbacks. During the switching of the valve, in particular, the impact of the magnetic plate against the body of the electromagnet causes a considerable energy loss in the form of noise, especially because of the considerable velocities of the magnetic plate during the impact.

As this energy is proportional to the second power of the velocity of the plate, it is essential to reduce the velocity of this plate at the moment of impact.

However, as the electromagnetic force increases sharply when the plate is approaching the electromagnet, which causes a great acceleration, it is not easy to reduce the velocity at the moment of impact.

It is known that the velocity can be reduced by regulating the current flowing in the electromagnet to control the magnetic field of this electromagnet.

However, it is not easy to embody such a regulator because the electromagnetic force of the electromagnet, which force is applied to the magnetic plate during the approach of the electromagnet, varies nonlinearly with the air gap.

This nonlinearity is illustrated in FIG. 2, which is a diagram showing the changes in the electromagnetic force (on the ordinate) as a function of the value of the air gap (on the abscissa).

The present invention remedies the above-mentioned drawback.

SUMMARY OF THE INVENTION

The present invention is embodied in a valve actuator for internal combustion engines, comprising at least one electromagnet and a magnetic plate, whose movement controls the displacement of the valve, which is characterized in that the parameters of the electromagnet and of the plate are such that at least part of the magnetic circuit formed by the electromagnet and by the plate is in a state of magnetic saturation when the magnetic plate is in the proximity of the electromagnet.

Thus, thanks to this saturation, the force of attraction exerted by the electromagnet on the plate varies quasi-linearly when the value of the air gap approaches zero, whereas this force of attraction varies hyperbolically in the prior-art devices. It is this quasi-linear variation that limits the velocity of impact of the plate against the body of the electromagnet.

It is not indispensable under these conditions to make use of a regulating circuit, and if such a circuit is used, it is simpler than the prior-art circuits.

The parameters that make it possible to obtain the saturation of at least part of the magnetic circuit are, in particular, the parameters of the material forming the plate or the electromagnet, and/or the shape, and/or the dimensions of the plate and/or of the electromagnet.

To minimize the switching time (passage from the open state to the closed state of the valve, and vice versa), the parameters are preferably such that the plate (or the electromagnet) is in a state of magnetic nonsaturation when it is located at a distance from the electromagnet.

To optimize the maximization of the velocity at the beginning of the course and the minimization of the velocity during the approach to the electromagnet, the parameters are preferably such that the state of magnetic saturation, especially of the plate, is brought about for an air gap between 0 mm and at most 1 mm.

Thus, the present invention pertains, in general, to a valve actuator for internal combustion engines, comprising at least one electromagnet and a magnetic plate, whose movement controls the displacement of the valve, which is characterized in that the parameters of the electromagnet and of the plate are such that at least part of the magnetic circuit formed by the electromagnet and the plate is in a state of magnetic saturation when the magnetic plate is located in the proximity of the electromagnet.

The parameters are preferably such that the magnetic circuit is in the state of magnetic nonsaturation when it is located at a distance from the electromagnet. For example, the parameters are such that at least part of the magnetic circuit is in the state of magnetic saturation in the case of an air gap between 0 mm and at most 1 mm.

The parameters of the electromagnet and of the plate comprise, according to one embodiment, parameters related to the shape and/or the dimensions and/or the nature of the material (or the materials) forming the plate and the body of the electromagnet and/or the intensity of the current flowing through the coil of the electromagnet.

In one embodiment, the thickness of the plate is such that this plate is magnetically saturated in the proximity of the electromagnet.

The magnetic plate has, for example, at least one contracted part intended to be saturated when this plate is in the proximity of the electromagnet.

In one embodiment, the material forming the plate has a saturation threshold that is lower than that of the material forming the body of the electromagnet.

In one embodiment, the actuator comprises a regulator controlling the current in the electromagnet.

The present invention also pertains to an internal combustion engine comprising at least one valve according to any of the above claims.

BRIEF DESCRIPTION OF THE DRAWINGS

Other characteristics and advantages of the present invention will appear from the description of some of its embodiments, the description being based on the attached drawings, in which.

DETAILED DECRIPTION

Figure 3A:
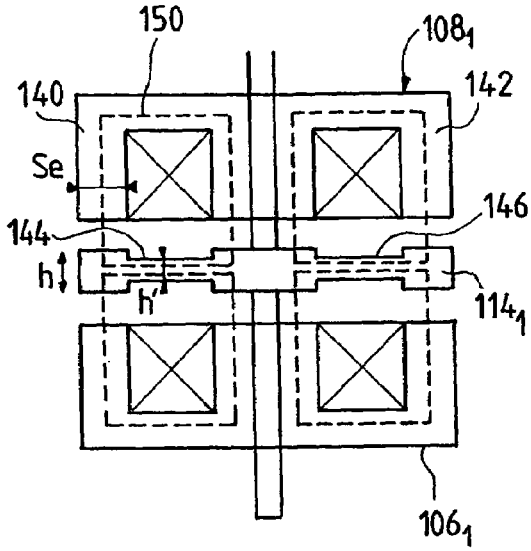
FIGS. 3*a* and 3*b* show sectional views of an actuator according to two embodiments of the present invention.

In the embodiment shown in FIG. 3*a*, the magnetic plate 114 has a thickness h on the same order of magnitude at its ends and in its center as the width Se of the end branches 140 and 142 of the magnetic circuit of the electromagnet 108 (or 106).

By contrast, the plate comprises parts 144 and 146 of a thickness h', which is appreciably smaller than the thickness h. Thus, the magnetic plate 114 has such a shape that it forms a contraction for the magnetic flux 150 generated by the electromagnet 108, such that this magnetic flux is concentrated in these contractions. As the magnetic flux 150 is conservative, the fact that the cross section of the plate 114 is reduced in some areas makes it possible to concentrate the magnetic induction in these parts 144 and 146 having a thickness h'. Thus, the magnetic induction has a high value in the contracted parts, and it is therefore possible to obtain saturation of the material in these parts 144 and 146.

When the magnetic plate 114 is moved away from the active electromagnet, the magnetic leakage is considerable, and a large part of the magnetic field enters the air rather than the plate. The magnetic flux in the plate is consequently weaker, and the material is not saturated.

Figure 1:
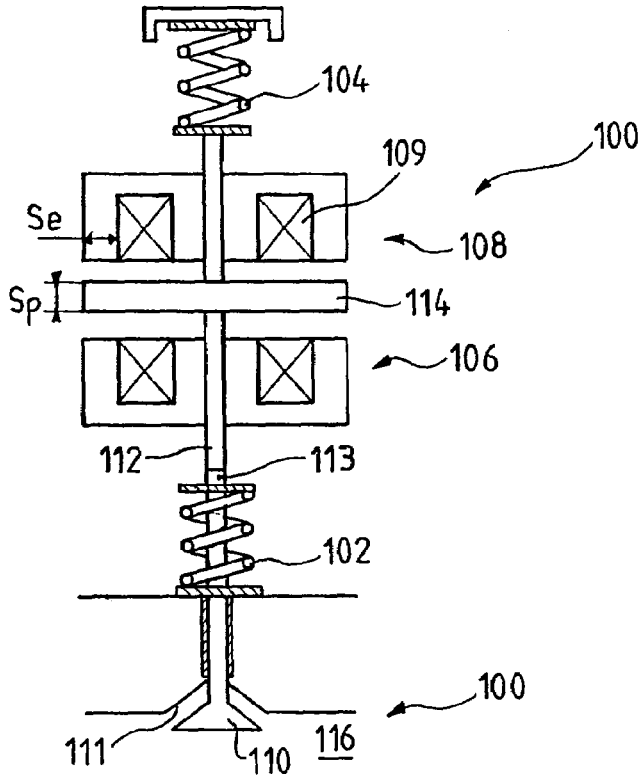
FIG. 1, already described, shows a prior-art actuator.
Figure 2:
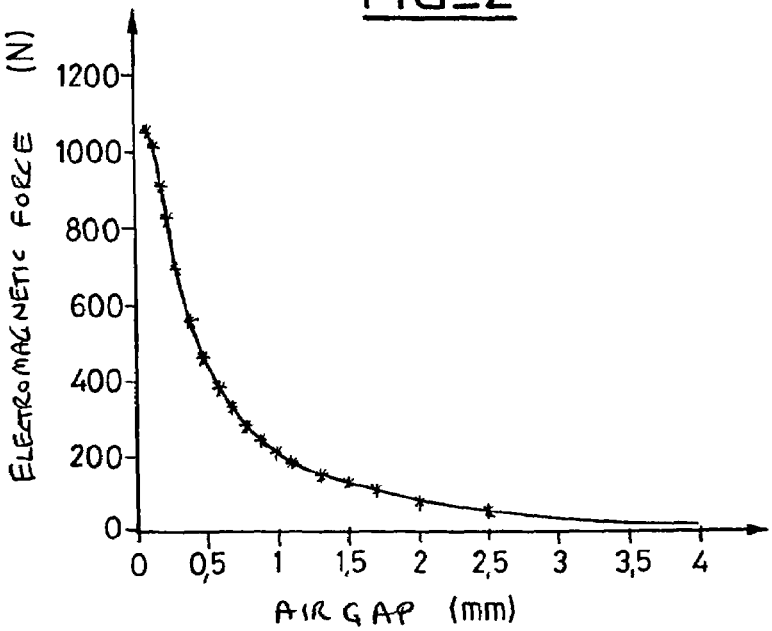
FIG. 2, already described, shows the variation in the magnetic force of the electromagnet on the plate as a function of the air gap for a prior-art actuator.

When the magnetic plate is close to an electromagnet, the magnetic flux 150 passes through the plate to a large extent, and the contracted parts 144 and 146 are saturated. Thus, when the plate is approaching the electromagnet, i.e., when the air gap is decreasing, the magnetic force of attraction does not increase hyperbolically, as in a conventional device. In addition, it is partly compensated by that of a spring corresponding to the spring 104 in FIG. 1.

Figure 3B:
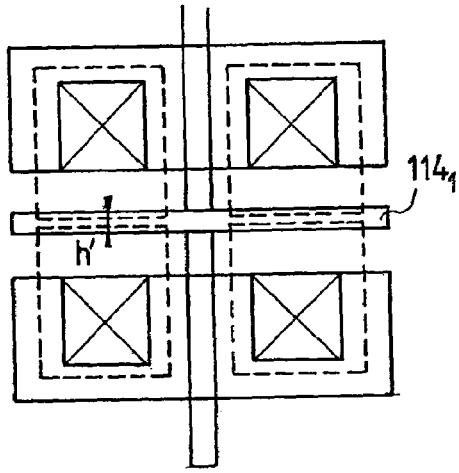

In a variant (FIG. 3*b*), the magnetic plate 114 has a constant thickness h'. The entire magnetic plate can thus be saturated. Moreover, the mass of the plate is even smaller, which leads to a further reduction in the energy loss, i.e., the noise. Moreover, with the reduced mass, the plate can be better accelerated at the beginning of its course because of its low inertia when it is still away from the electromagnet attracting it.

It is thus possible to select different magnetic materials for the electromagnet and the plate, such that the saturation threshold of the plate will be lower than that of the electromagnet.

According to a variant, the body of the electromagnet is such that it is saturated when the air gap is small.

For example, the width of the branches of the electromagnet can be reduced, thus leaving more place for the winding and making it possible to use wires of a larger diameter for the winding, thus reducing the resistance of the electromagnet and consequently its power consumption.

According to one embodiment, a regulation is used in combination with the present invention. This regulation is facilitated by the better linearity of the force of attraction, which makes it possible to control the plate more easily during its approach to the electromagnet.

Figure 4:
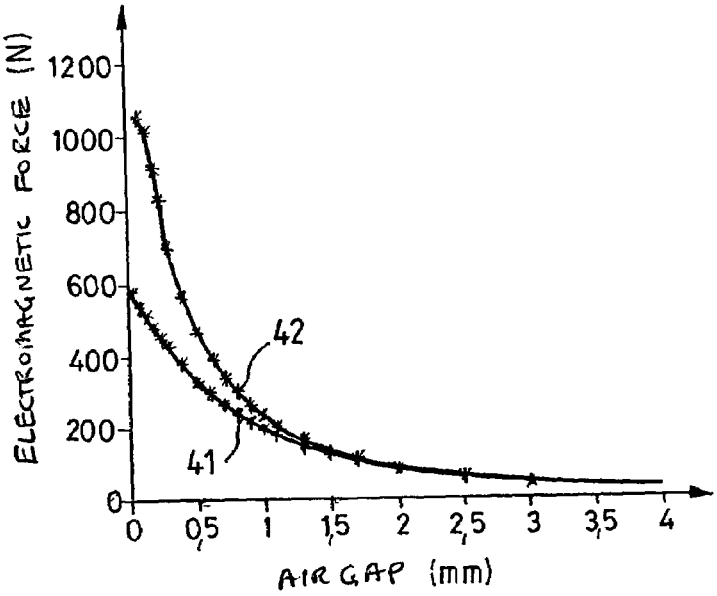
FIG. 4 is a diagram analogous to that in FIG. 2, showing the magnetic force of the electromagnet on the plate as a function of the air gap for a device according to the present invention and for a prior-art device.

Curve 41 in the diagram in FIG. 4 illustrates the variation in the force as a function of the value of the air gap for an actuator according to the present invention, whereas curve 42 corresponds to a prior-art actuator. Curve 41 becomes linear during the approach of the electromagnet, whereas the air gap tends toward zero when curve 42 rises hyperbolically.

It was observed that the velocity of impact of the plate against the electromagnet attracting it, which can be obtained with the present invention, is less than 0.1 m/sec both during the phases of opening and closing of the valve. The mobile plate is not accelerated in the vicinity of its position in which it comes into contact with the electromagnet.

What is claimed is:

1. A valve actuator for internal combustion engines, comprising at least one electromagnet having a coil and a magnetic plate, whose movement controls the displacement of the valve, wherein the parameters of the electromagnet and of the plate are such that at least part of the magnetic circuit formed by the electromagnet and the plate is in a state of magnetic saturation when the magnetic plate is in the proximity of the electromagnet, so as to minimize the force of attraction exerted on the plate and therefore its velocity; the parameters of the electromagnet and of the plate and the shape of the plate being such that the magnetic circuit is in the state of magnetic nonsaturation when the plate is located at a distance from the electromagnet, so as to maximize the force attraction exerted on the plate and therefore to minimize the switching time, wherein the plate has flat faces.

2. The valve actuator in accordance with claim 1, wherein the parameters are such that at least part of the magnetic circuit is in the state of magnetic saturation for an air gap between the plate and the electromagnet of between 0 mm and at most 1 mm.

3. The valve actuator in accordance with claim 1 or 2, wherein the parameters of the electromagnet and of the plate comprise parameters related to at least one of the shape, the dimensions of the plate, the nature of the material forming the plate and the body of the electromagnet and the intensity of the current flowing through the coil of the electromagnet.

4. The valve actuator in accordance with claim 3, wherein the thickness of the plate is such that this plate is magnetically saturated in the proximity of the electromagnet.

5. The valve actuator in accordance with claim 3, wherein the material forming the plate has a lower saturation threshold than the material forming the body of the electromagnet.

6. The valve actuator in accordance with one of the claims 1 or 2, further comprising a regulator controlling the current in the electromagnet.

7. An internal combustion engines, comprising:

at least one valve actuator in accordance with claim 1 or 2.

8. A valve actuator for internal combustion engines, comprising:

at least one electromagnet having a coil and a magnetic plate, whose movement controls the displacement of the valve, wherein the parameters of the electromagnet and of the plate are such that at least part of the magnetic circuit formed by the electromagnet and the plate is in a state of magnetic saturation when the magnetic plate is in the proximity of the electromagnet, so as to minimize the force of attraction exerted on the plate and therefore its velocity; the parameters of the electromagnet and of the plate and the shape of the plate being such that the magnetic circuit is in the state of magnetic nonsaturation when the plate is located at a distance from the electromagnet, so as to maximize the force attraction exerted on the plate and therefore to minimize the switching time, wherein an air gap is provided between the electromagnet and the magnetic plate when the plate is adjacent to the electromagnet.

9. The valve actuator in accordance to claim 8, wherein when the air gap is provided between the electromagnet and the plate when the latter is adjacent to the electromagnet, the plate has recesses on each face, each recess having a flat bottom parallel to an outward corresponding face, and separated by walls perpendicular to such flat faces.

10. The valve actuator in accordance with claim 8, wherein the parameters are such that at least part of the magnetic circuit is in the state of magnetic saturation for an air gap between the plate and the electromagnet of greater than 0 mm and at most 1 mm.

11. The valve actuator in accordance with claim 8, wherein the parameters of the electromagnet and of the plate comprise parameters related to at least one of the shape, the dimensions of the plate, the nature of the material forming the plate and the body of the electromagnet and the intensity of the current flowing through the coil of the electromagnet.

12. The valve actuator in accordance with claim 11, wherein the thickness of the plate is such that this plate is magnetically saturated in the proximity of the electromagnet.

13. The valve actuator in accordance with claim 11, wherein the magnetic plate has at least one contracted part intended to be saturated when this plate is located in the proximity of the electromagnet.

14. The valve actuator in accordance with claim 11, wherein the material forming the plate has a lower saturation threshold than the material forming the body of the electromagnet.

15. The valve actuator in accordance with claim 8, further comprising a regulator controlling the current in the electromagnet.

16. An internal combustion engines, comprising:

at least one valve actuator in accordance with claim 8.

* * * * *